US009657532B2

(12) United States Patent
Stokes

(10) Patent No.: US 9,657,532 B2
(45) Date of Patent: May 23, 2017

(54) ADJUSTABLE SHEAR ASSEMBLY

(71) Applicant: Halliburton Energy Services, Inc., Houston, TX (US)

(72) Inventor: Matthew Bradley Stokes, Fort Worth, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 199 days.

(21) Appl. No.: 14/412,065

(22) PCT Filed: Nov. 4, 2013

(86) PCT No.: PCT/US2013/068320

§ 371 (c)(1),
(2) Date: Dec. 30, 2014

(87) PCT Pub. No.: WO2015/065493

PCT Pub. Date: May 7, 2015

(65) Prior Publication Data

US 2016/0281442 A1 Sep. 29, 2016

(51) Int. Cl.

| | |
|---|---|
| ***E21B 17/06*** | (2006.01) |
| ***E21B 23/00*** | (2006.01) |
| ***E21B 17/046*** | (2006.01) |
| ***E21B 17/20*** | (2006.01) |
| *E21B 33/12* | (2006.01) |
| *E21B 34/06* | (2006.01) |

(52) U.S. Cl.

CPC ..... *E21B 17/046* (2013.01); *E21B 17/06* (2013.01); *E21B 17/20* (2013.01); *E21B 17/206* (2013.01); *E21B 23/00* (2013.01); *E21B 33/12* (2013.01); *E21B 34/06* (2013.01)

(58) Field of Classification Search

CPC ..... E21B 17/06
USPC ..... 285/3, 4
See application file for complete search history.

(56) References Cited

U.S. PATENT DOCUMENTS

| | | | | |
|---|---|---|---|---|
| 3,268,239 A * | 8/1966 | Castor | E21B 33/043 166/237 |
| 4,184,408 A | 1/1980 | Smith et al. | |
| 4,186,570 A | 2/1980 | Pokrandt | |
| 4,218,896 A | 8/1980 | van der Lely | |
| 4,392,623 A | 7/1983 | Munsen et al. | |

(Continued)

OTHER PUBLICATIONS

Authorized Officer Jong Kyung Lee, PCT International Search Report and Written Opinion of the International Searching Authority, PCT/US2013/068320, Aug. 5, 2014, 9 pages.

*Primary Examiner* — Giovanna C Wright
(74) *Attorney, Agent, or Firm* — Scott Richardson; Parker Justiss, P.C.

(57) ABSTRACT

A well tool has an inner and outer component arranged to move relative to one another and defining a shear juncture therebetween. A shear member spans the shear juncture. The shear member has first portion with a different cross-sectional area than a second portion. A cam surface is associated with the inner or outer component and abuts the shear member. The cam surface moves the shear member as the inner and outer components move relative to one another and changes the shear member from having the first portion aligned with the shear juncture to having the second portion aligned with the shear juncture.

19 Claims, 3 Drawing Sheets

FIG. 2B

FIG. 3B

(56) References Cited

U.S. PATENT DOCUMENTS

| | | | | |
|---|---|---|---|---|
| 4,405,263 | A * | 9/1983 | Hall | B63C 11/52 114/294 |
| 4,443,130 | A * | 4/1984 | Hall | B63C 11/52 166/340 |
| 4,726,424 | A | 2/1988 | Raulins | |
| 4,754,814 | A | 7/1988 | Jordan, Jr. | |
| 4,940,089 | A | 7/1990 | Terral | |
| 5,005,650 | A | 4/1991 | Hopper | |
| 5,074,361 | A | 12/1991 | Brisco et al. | |
| 5,350,242 | A | 9/1994 | Wenzel | |
| 7,237,617 | B2 | 7/2007 | Howlett | |
| 7,243,728 | B2 | 7/2007 | Stoesz et al. | |
| 8,434,984 | B2 | 5/2013 | Toosky | |
| 8,654,700 | B2 * | 2/2014 | Fukuzawa | H04B 7/15542 370/281 |
| 2002/0023782 | A1 | 2/2002 | Appleton et al. | |
| 2004/0060710 | A1 * | 4/2004 | Marshall | E21B 10/322 166/381 |
| 2009/0145605 | A1 | 6/2009 | Kratochvil et al. | |
| 2012/0103625 | A1 | 5/2012 | Yates | |
| 2013/0140019 | A1 * | 6/2013 | Pare | E21B 17/06 166/117.5 |
| 2015/0376958 | A1 * | 12/2015 | Ringgenberg | E21B 34/063 166/373 |

* cited by examiner

ADJUSTABLE SHEAR ASSEMBLY

BACKGROUND

The present disclosure relates to well tools that utilize shear members.

Many well tools have components pinned together by a shear member. A shear member is pin, a screw, or other member that spans the shear plane between two components to fix the components against movement in a direction along their shear plane. The shear member is designed to fail under a specified shear loading, thus holding the components against relative movement until the specified shear loading is achieved. In designing shear members, a balance must be achieved between the specified shear load at which the shear member fails and ancillary loads that may be encountered by the components. For example, if the designed specified shear loading is too low, the shear member may unintentionally shear. If the designed specified shear loading is too high, there may be circumstances when it is difficult or impossible to shear the shear member. In the context of a tool for use in a well, the need for balance is particularly accute, because of the environment. For example, the components of the tool may be subjected to shear loads, both constant and impact, as the tool is moved uphole and downhole in the well or as the tool is otherwise manipulated. Further, if the shear member prematurely shears, the tool may not function and then require a lengthy and costly trip to the surface to reset the tool.

DESCRIPTION OF DRAWINGS

Like reference symbols in the various drawings indicate like elements.

DETAILED DESCRIPTION

Figure 1:
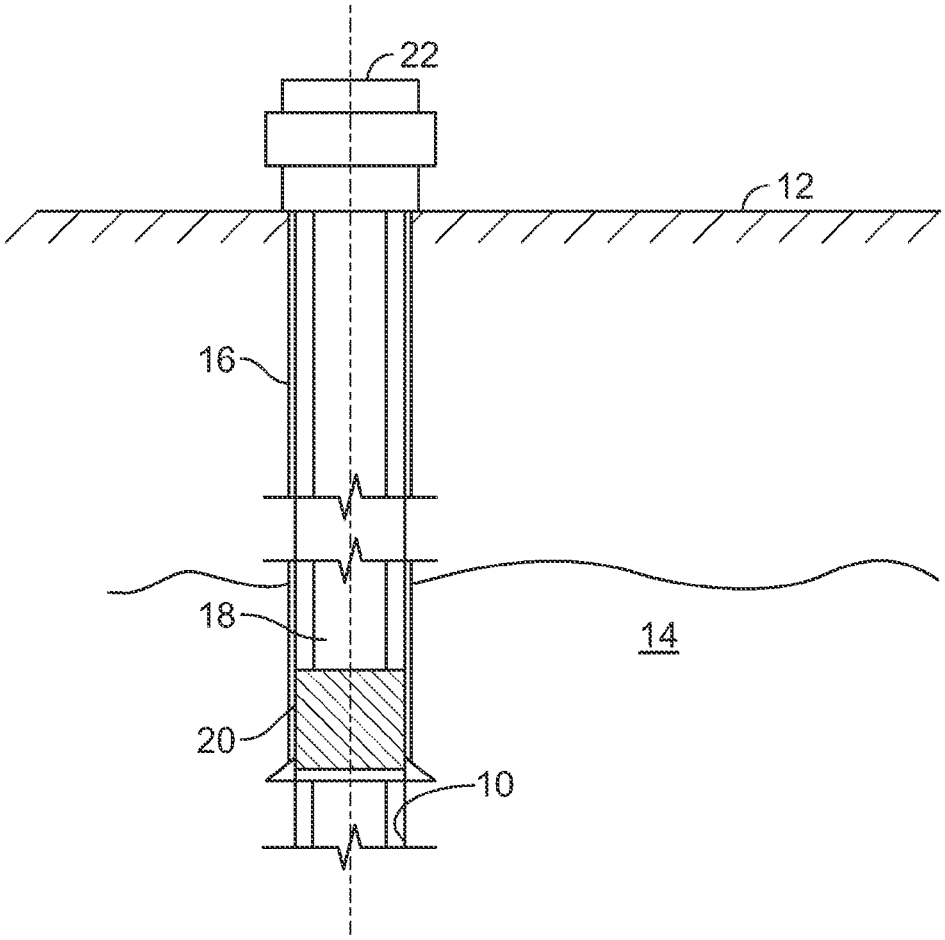
FIG. 1 is a schematic side view of a well incorporating a well tool.

Referring first to FIG. 1, a well includes a substantially cylindrical wellbore 10 that extends from a wellhead 22 at the surface 12 downward into the Earth into one or more subterranean zones of interest 14 (one shown). The subterranean zone 14 can correspond to a single formation, a portion of a formation, or more than one formation accessed by the well, and a given well can access one or more than one subterranean zone 14. In certain instances, the formations of the subterranean zone are hydrocarbon bearing, such as oil and/or gas deposits, and the well will be used in producing the hydrocarbons and/or used in aiding production of the hydrocarbons from another well (e.g., as an injection or observation well). The concepts herein, however, are applicable to virtually any type of well. A portion of the wellbore 10 extending from the wellhead 22 to the subterranean zone 14 is lined with lengths of tubing, called casing 16.

The depicted well is a vertical well, extending substantially vertically from the surface 12 to the subterranean zone 14. The concepts herein, however, are applicable to many other different configurations of wells, including horizontal, slanted or otherwise deviated wells, and multilateral wells.

A tubing string 18 is shown as having been lowered from the surface 12 into the wellbore 10. The tubing string 18 is a series of jointed lengths of tubing coupled together end-to-end and/or a continuous (i.e., not jointed) coiled tubing, and includes one or more well tools (e.g., one shown, well tool 20). The string 18 has an interior, center bore that enables communication of fluid between the wellhead 22 and locations downhole (e.g., the subterranean zone 14 and/or other locations). In other instances, the string 18 can be arranged such that it does not extend from the surface 12, but rather depends into the well on a wire, such as a slickline, wireline, e-line and/or other wire.

Figure 2A:
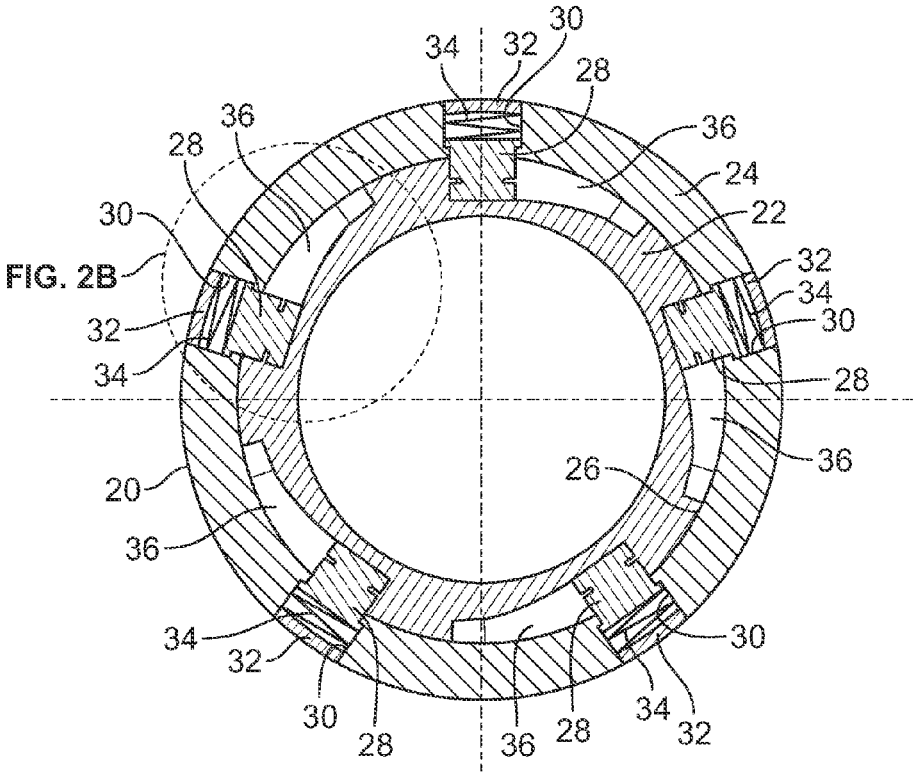
FIG. 2A is an axial cross-sectional view of an example well tool with inner and outer tubings pinned by a shear member.

Referring to FIG. 2A, the well tool 20 is shown in an axial cross-sectional view. The well tool 20 is of a type having a first component, e.g., an inner tubing 22, arranged with a second component, e.g., an outer tubing 24, so that the components can move relative to one another. The well tool 20 has a shear member arrangement that pins or fixes the two tubings 22, 24 together and prevents relative movement in a specified direction, but that can be sheared to release the two tubings 22, 24 to move. The well tool 20 can be a number of different tools incorporating components (tubular or not) that move relative to one another. In certain instances, the tool 20 is a valve where the inner and outer tubings move relative to one another in opening and closing the valve. In certain instances, the tool 20 is a packer where the inner and outer tubings move relative to one another in setting the packer. Other types of well tools are within the concepts herein.

As shown, inner tubing 22 is nested concentrically in the outer tubing 24 with the outer surface of the inner tubing 22 adjacent and abutting the inner surface of the outer tubing 24. The inner tubing 22 and outer tubing 24 can be moved relative to one another, for example, rotated around their common central axis or telescoped axially along their common central axis. The juncture between the inner tubing 22 and the outer tubing 24 defines a shear juncture 26 where the surfaces of the tubings 22, 24 move adjacent to one another. One or more shear members 28 are carried in a corresponding number of openings 30 in the outer tubing 24. Five shear members 28 and openings 30 are shown, but fewer or more could be provided. The shear members 28 span the shear juncture 26, and protrude into a corresponding number of cam slots 36 in the inner tubing 22.

The shear members 28 are carried in the openings 30 in a manner that allows the shear members 28 to move radially. In certain instances, the shear members 28 are cylindrical and the openings 30 round, but other shapes could be provided. Each of the openings 30 has a cap 32 with a spring 34 trapped between the cap 32 and the shear member 28. The spring 34 biases the shear member 28 radially inward to abut the bottom cam surface 38 of the cam slot 36. In certain instances, the spring 34 is a metallic coil or wave spring, but the spring 34 can take many other different forms. For example, the spring 34 could be a elastomer bushing, a fluid spring and/or other type of spring. In still other instances, the spring 34 can be omitted and the shear members 28 can be biased radially inward in another manner (e.g., magnets and/or other).

The cam slots 36 are elongate and extend, in their long dimension, circumferentially around the inner tubing 22. The width of the cam slots 36 is sized to tightly receive the shear members 28. Thus, the shear members 28 are restrained in the cam slots 36 against telescoping movement along the longitudinal axis of the tubings 22, 24, and fix the inner and outer tubings 22, 24 against relative axial movement. However, the tubings 22, 24 can rotate relative to one another around their common central axis to the extents of the slots 36.

Figure 2B:
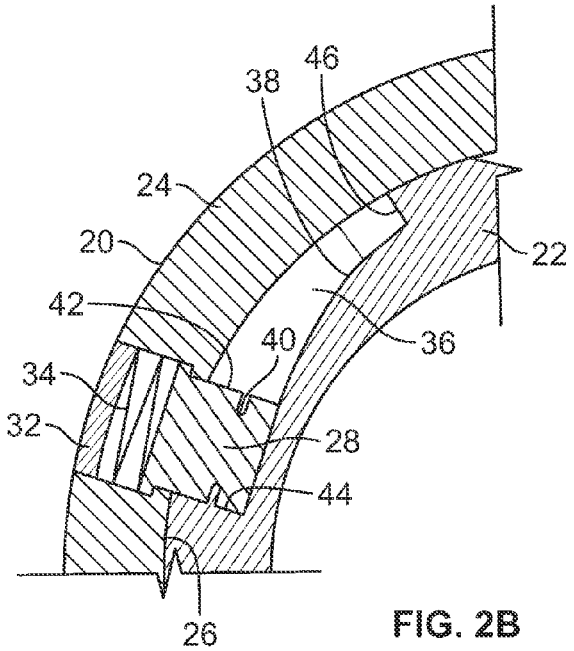
FIG. 2B is a detail view of the example well tool of FIG. 2A.
Figure 3A:
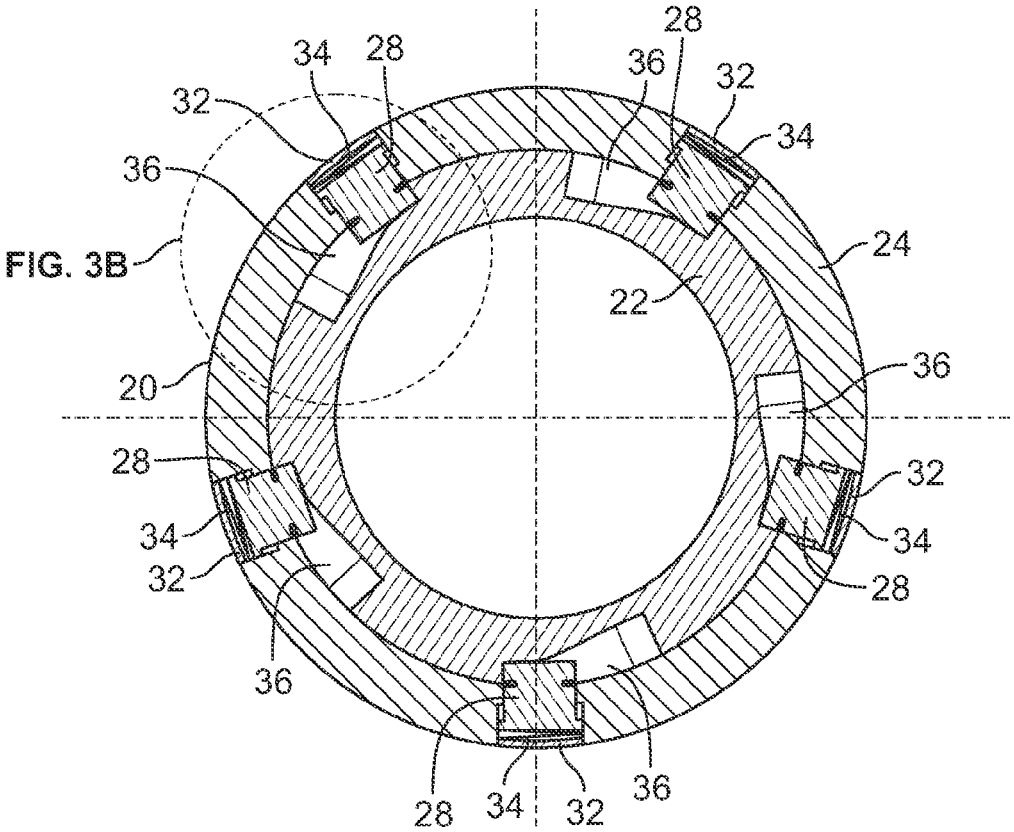
FIG. 3A is an axial cross-section view of the example well tool of FIG. 2A with the shear member positioned to provide a reduced resistance to shear loads.
Figure 3B:
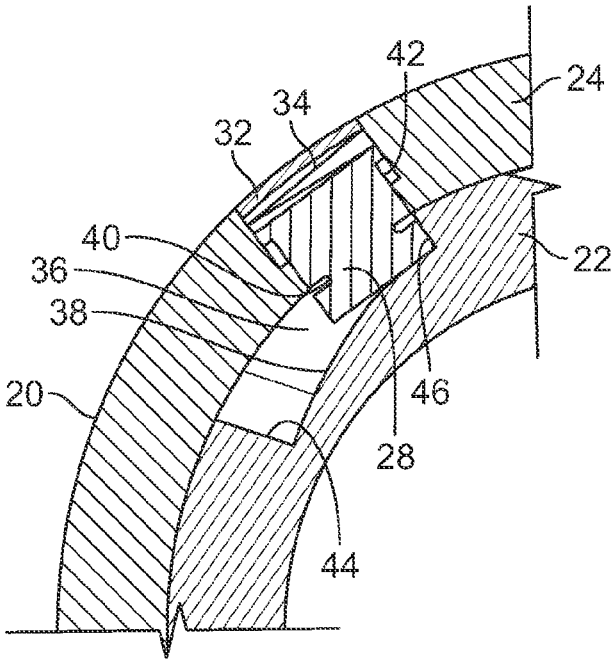
FIG. 3B is a detail view of FIG. 3A.

As best seen in FIG. 2B, the shear members 28 have at least two portions of different cross-sectional area, thus presenting at least two different resistances to shear. Two portions, portion 40 having a smaller cross-sectional area than portion 42, are shown in FIG. 2B, but more could be provided. The bottom cam surface 38 of each cam slot 36 is ramped along the circumference of the inner tubing 22, from one end of the cam slot to the other. In other words, each cam slot 36 is deeper at one end than the other. In FIG. 2B, shear member 28 is abutting a left end wall 44 of a cam slot 36, which is also the deeper end of the slot 36. The depth of the cam slot 36 is such that, with the shear member 38 abutting the left wall 44, the larger cross-sectional portion 42 of the shear member 28 is aligned with the shear juncture 26. Rotating the tubings 22, 24 relatively to one another around their common central axis moves the shallower end of the slot 36 under shear member 28, as shown in FIGS. 3A and 3B, and cams the shear member 28 radially outward. The depth at the shallower end of the cam slot 36 is such that, with the shear member 28 abutting a right end wall 46 of the cam slot 36, the smaller cross-section portion 40 of the shear member 28 is aligned with the shear juncture 26. Thus, the tool 20 can be changed between shearing the shear member 28 at a lower shear load and a higher shear load by relatively rotating the inner tubing 22 and outer tubing 24. As shown in FIG. 3A, all of the cam slots 36 can be phased to simultaneously align their respective portion 40 of smaller cross-sectional area with the shear junction 26 at the same rotational position. Similarly, also as shown in FIG. 3A, all of the cam slots 36 can be phased to simultaneously align their respective portion 42 of larger cross-sectional area with the shear junction 26 at the same rotational position. In other instances, the cam slots 36 and/or shear members 28 can be phased differently, for example, to produce different shear resistances at different relative rotations of the tubings 22, 24.

In certain instances, the portion 42 of larger cross-sectional area can be configured to provide a much higher resistance to shear than the portion 40 of smaller cross-sectional area. This arrangement enables the tool 20 to, in effect, lock the tubings 22, 24 together, for example, for manipulating the tool 20 in the well, without fear of unintentionally shearing the shear member 28. For example, the tool 20 can be initially configured with the shear member portion 42 of larger cross-sectional area spanning the shear junction 26 to enable the tool to be carried into the well and manipulated uphole and downhole as needed. Then, when it is desired to operate the well tool 20, the tool 20 can be configured with the shear member portion 40 of smaller cross-sectional area spanning the shear junction 26.

Notably, although described above with the cam slots 36 oriented and ramped in a circumferential direction, the cam slots 36 can alternately be oriented and ramped in an axial direction. With axially ramped cam slots 36, the tubings 22, 24 would be shifted axially to change alignment of the shear members 28, and the shear members 28 are provided to resist relative rotational movement of the tubings 22, 24. Additionally, although described with the cam slots 36 on the inner tubing 22 and the shear members 28 carried in the outer tubing 24, in other instances, the outer tubing 24 could have some or all of the cam slots 36 and the inner tubing 22 could carry some or all of the shear members 28.

A number of embodiments have been described. Nevertheless, it will be understood that various modifications may be made. Accordingly, other embodiments are within the scope of the following claims.

What is claimed is:

1. A well tool, comprising:

an inner and outer tubings nested to move relative to one another and defining a shear juncture therebetween where a surface of the inner tubing is adjacent a surface of the outer tubing;

a shear member spanning the shear juncture, the shear member having a first portion with a different cross-sectional area than a second portion; and a cam surface associated with the inner tubing or the outer tubing that abuts the shear member and moves the shear member as the inner and outer tubings move relative to one another and changes the shear member between having the first portion aligned with the shear juncture to having the second portion aligned with the shear juncture, wherein the cam surface extends in a circumferential direction to move the shear member radially when the inner and outer tubings are rotated relative to one another.

2. The well tool of claim 1, where the cam surface is ramped to move the shear member radially.

3. The well tool of claim 2, where the shear member is arranged to hold the inner and outer tubings from moving axially relative to one another until the shear member is sheared.

4. The well tool of claim 1, where the shear member is biased into the cam surface.

5. The well tool of claim 1, where the cam surface is defined by a surface of the inner tubing.

6. The well tool of claim 5, where the outer tubing comprises a shear member opening receiving the shear member and comprising a spring in the shear member opening biasing the shear member inward into the cam surface of the inner tubing.

7. The well tool of claim 1, comprising a second shear member spanning the shear juncture and having a first portion with a different cross-sectional area than the second portion of the second shear member; and comprising a second cam surface that abuts the second shear member and moves the second shear member as the inner and outer tubings move relative to one another and changes the second shear member between having the second shear member first portion aligned with the shear juncture to having the second shear member second portion aligned with the shear juncture.

8. The well tool of claim 7, where the first mentioned cam surface and the second cam surface are phased to simultaneously align the second portion of the two shear members with the shear juncture.

9. A method, comprising:

spanning a shear juncture of a well tool in a well with a first portion of a shear member, the shear juncture being between inner and outer tubings of the well tool; and moving the first portion of the shear member apart from the shear juncture and a second portion of the shear member to spanning the shear juncture, the second portion having a larger cross-sectional area than the first portion, wherein said moving includes moving the inner tubing or the outer tubing relative to the other.

10. The method of claim 9, where spanning the shear juncture of the well tool in the well with the first portion of the shear member comprises affixing the inner and outer tubings of the well tool against movement in a direction.

11. The method of claim 9, where moving the inner tubing or the outer tubing comprises camming the shear member to move radially.

12. The method of claim 11, where moving the inner tubing or outer tubing comprises rotating the inner tubing or the outer tubing relative to the other.

13. The method of claim 9, comprising moving a first portion of a second shear member from spanning the shear juncture to apart from the shear juncture and a second portion of the second shear member to spanning the shear juncture.

14. The method of claim 13, comprising moving the first shear member and second shear member simultaneously.

15. A well device for use in a well, comprising:

a first well device component adjacent to a second well device component and defining a shear junction therebetween; and a shear member spanning the shear junction to fix the first and second components against relative movement in a direction, the shear member changeable between providing a first resistance to shear loads across the shear junction and a second, different resistance to shear loads across the shear junction, wherein the first well device component comprises a cam surface that cams the shear member to align different portions of the shear member with the shear junction.

16. The well device of claim 15, where the shear member comprises at least two portions of different cross-sectional area, and where moving the shear member to align different portions of the shear member with the shear junction changes the shear member between providing the first resistance to shear loads across the shear junction and the second, different resistance to shear loads across the shear junction.

17. The well device of claim 15, where the cam surface abuts the shear member.

18. The well device of claim 15, where the first well device component is a first tubing and the second well device component is a second tubing nested to telescope with the first tubing.

19. The well device of claim 15, where the cam surface moves the shear member between aligning a first portion with the first resistance to shear loads with the shear junction and aligning a second portion of the shear member with the second, different resistance to shear loads with the shear junction.

* * * * *